US008007327B2

(12) United States Patent
Yang et al.

(10) Patent No.: US 8,007,327 B2
(45) Date of Patent: Aug. 30, 2011

(54) ELECTRICAL CONNECTOR HAVING POSITIONING POSTS DEFINED ON INSULATIVE BASE

(75) Inventors: Sheng-Ho Yang, Tu-Cheng (TW); Tsu-Yang Wu, Tu-Cheng (TW); Chun-Chieh Yang, Tu-Cheng (TW); Hsin-Kai Huang, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/615,283

(22) Filed: Nov. 10, 2009

(65) Prior Publication Data

US 2010/0120283 A1 May 13, 2010

(30) Foreign Application Priority Data

Nov. 10, 2008 (CN) ..... 097220130

(51) Int. Cl.
*H01R 4/48* (2006.01)

(52) U.S. Cl. ..... 439/862

(58) Field of Classification Search ..... 439/862, 439/172, 680, 378, 65, 66, 638, 374, 357
See application file for complete search history.

(56) References Cited

U.S. PATENT DOCUMENTS

| | | | | |
|---|---|---|---|---|
| 5,620,329 | A * | 4/1997 | Kidd et al. | 439/248 |
| 6,241,558 | B1 * | 6/2001 | Mosquera | 439/660 |
| 6,331,122 | B1 * | 12/2001 | Wu | 439/567 |
| 6,663,434 | B1 * | 12/2003 | Wu | 439/638 |
| 6,743,053 | B2 * | 6/2004 | Wu | 439/634 |
| 6,764,344 | B2 * | 7/2004 | Maiers | 439/629 |
| 6,811,427 | B2 * | 11/2004 | Garrett et al. | 439/378 |
| 6,832,929 | B2 * | 12/2004 | Garrett et al. | 439/378 |
| 6,887,108 | B2 * | 5/2005 | Wu | 439/638 |
| 6,908,330 | B2 * | 6/2005 | Garrett et al. | 439/378 |
| 6,994,577 | B2 * | 2/2006 | Margulis et al. | 439/247 |
| 7,059,919 | B2 * | 6/2006 | Clark et al. | 439/825 |
| 7,112,103 | B2 * | 9/2006 | Zhang et al. | 439/700 |
| 7,316,578 | B2 * | 1/2008 | Ono et al. | 439/172 |
| 7,473,114 | B2 * | 1/2009 | Chen et al. | 439/159 |
| 7,572,130 | B1 * | 8/2009 | Zhang | 439/79 |
| 7,857,638 | B2 * | 12/2010 | Zhu | 439/78 |
| 2003/0003809 | A1 * | 1/2003 | Maiers | 439/629 |
| 2003/0096517 | A1 * | 5/2003 | Ho | 439/79 |
| 2006/0052006 | A1 * | 3/2006 | Amano et al. | 439/638 |
| 2007/0249200 | A1 * | 10/2007 | Chen et al. | 439/159 |

FOREIGN PATENT DOCUMENTS

CN 2755801 2/2006

* cited by examiner

*Primary Examiner* — T C Patel
*Assistant Examiner* — Harshad C Patel
(74) *Attorney, Agent, or Firm* — Wei Te Chung; Andrew C. Cheng; Ming Chieh Chang

(57) ABSTRACT

An electrical connector assembly includes an insulative base and a complimentary connector assembled therewith along an up-to-down direction instead of a left-to-right direction. Thus, a small assembly space will be achieved compared to the prior art.

11 Claims, 5 Drawing Sheets

ELECTRICAL CONNECTOR HAVING POSITIONING POSTS DEFINED ON INSULATIVE BASE

BACKGROUND OF THE INVENTION

1. Field of the Invention

The present invention relates to an electrical connector, and more particularly to an electrical connector having positioning posts defined on the insulative base for positioning a complimentary connector during mating.

2. Description of the Prior Art

Chinese Utility Patent No. CN 2755801 issued to HE ZE-YI on Feb. 1, 2006, discloses a receptacle connector for being mounted on a printed circuit board. The electrical connector comprises an insulative housing, a plurality of terminals disposed therein and a pair of locking elements locking the electrical connector with the circuit board. Each terminal comprises a planar retention portion, an extending portion and a soldering portion extending from two opposite ends of the retention portion respectively. The soldering portion has a soldering tail being soldered on the printed circuit board. The insulative housing includes a front mating section and a back base section from which the mating section forwards extending. The receptacle connector is mated with a plug connector mounted on an outer device such as a hard disk. The outer device displaces a certain distance to be inserted into the receptacle connector relative to the printed circuit board since the right angle type receptacle connector decides a horizontally-oriented mating direction. Thus, an additional space for the movement of the outer device will be requested on the printed circuit board which will waste same area of the printed circuit board. Nowadays, with a miniaturization trend in the connector industry, even a small real estate on the printed circuit board is precious since additional electronic components or conductive traces can be deployed. Further more, an assembling trace formed on the electrical connector for guiding the complimentary electrical connector is also required.

Hence, an improved electrical connector is desired to overcome the disadvantages of the prior art.

BRIEF SUMMARY OF THE INVENTION

Therefore, an object of the present invention is to provide an electrical connector in which only a small mounting area is needed when mounted on a printed circuit board.

To fulfill the above-mentioned object, an electrical connector comprising an insulative base comprising a longitudinal base section with a top face and three positioning posts protruding upwardly form the top face along the longitudinal direction, the base section defining two groups of receiving passageways, each group located between every adjacent two positioning posts, each receiving passageway running through the top face of the base section and a front face perpendicular to the top face; a plurality of terminals retained in the receiving passageways, each terminal comprising a retention section, a resilient arm received in the passageway with an contacting end at a free end of the resilient arm, a soldering section extending out of the front face, wherein the contacting end is an arc-shape with an opening orient to the top face.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
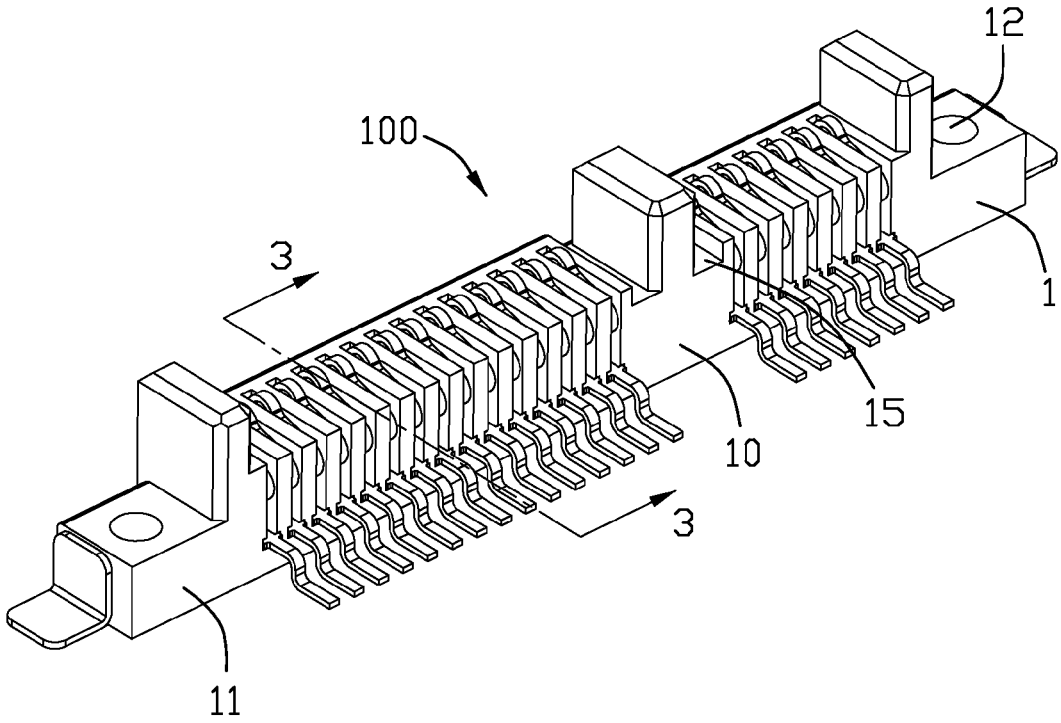
FIG. 1 is a perspective view of an electrical connector made in accordance with the present invention.
Figure 4:
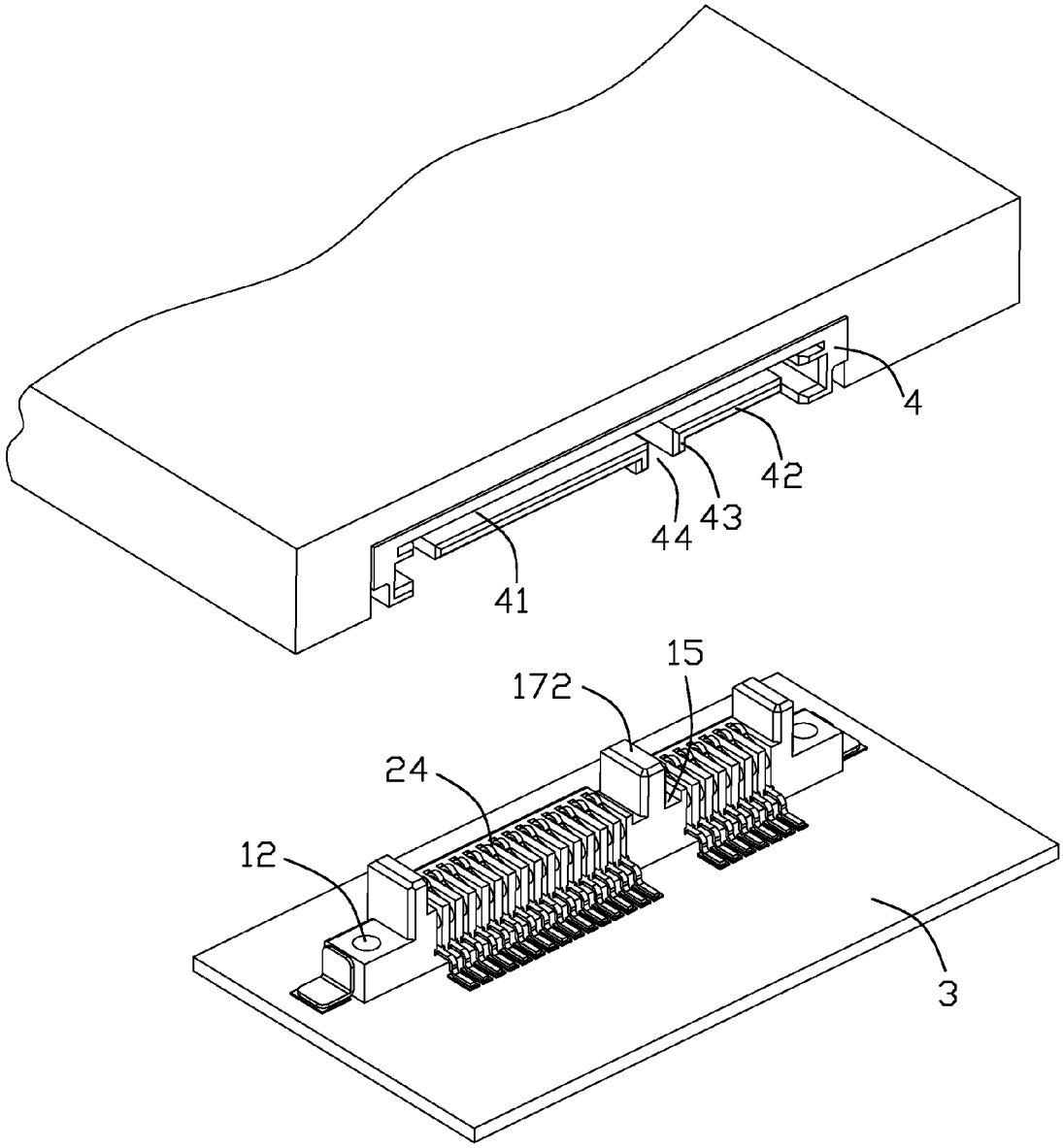
FIG. 4 is a perspective view of the connector shown in FIG. 1 with a complementary connector on the top.
Figure 5:
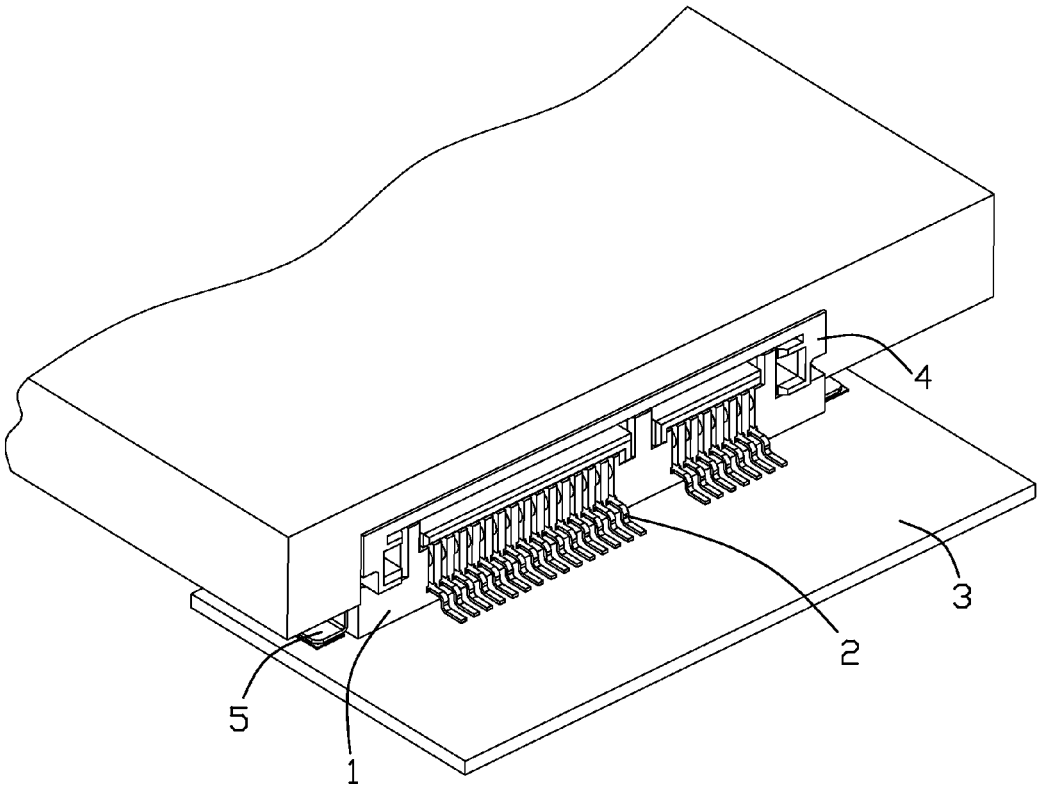
FIG. 5 is a perspective view of the connector shown in FIG. 1 in which a complementary connector shown in portion is mated thereto.

Referring to FIGS. 1 and 4, an electrical connector 100 according to the present invention is adapted for being mounted on a circuit board 3 and mating with a complementary connector 4 in an outer electronic device, such as a hard disk drive. The electrical connector 100 comprises an insulative base 1 and a plurality of terminals 2 received in the insulative base 1 respectively.

Figure 2:
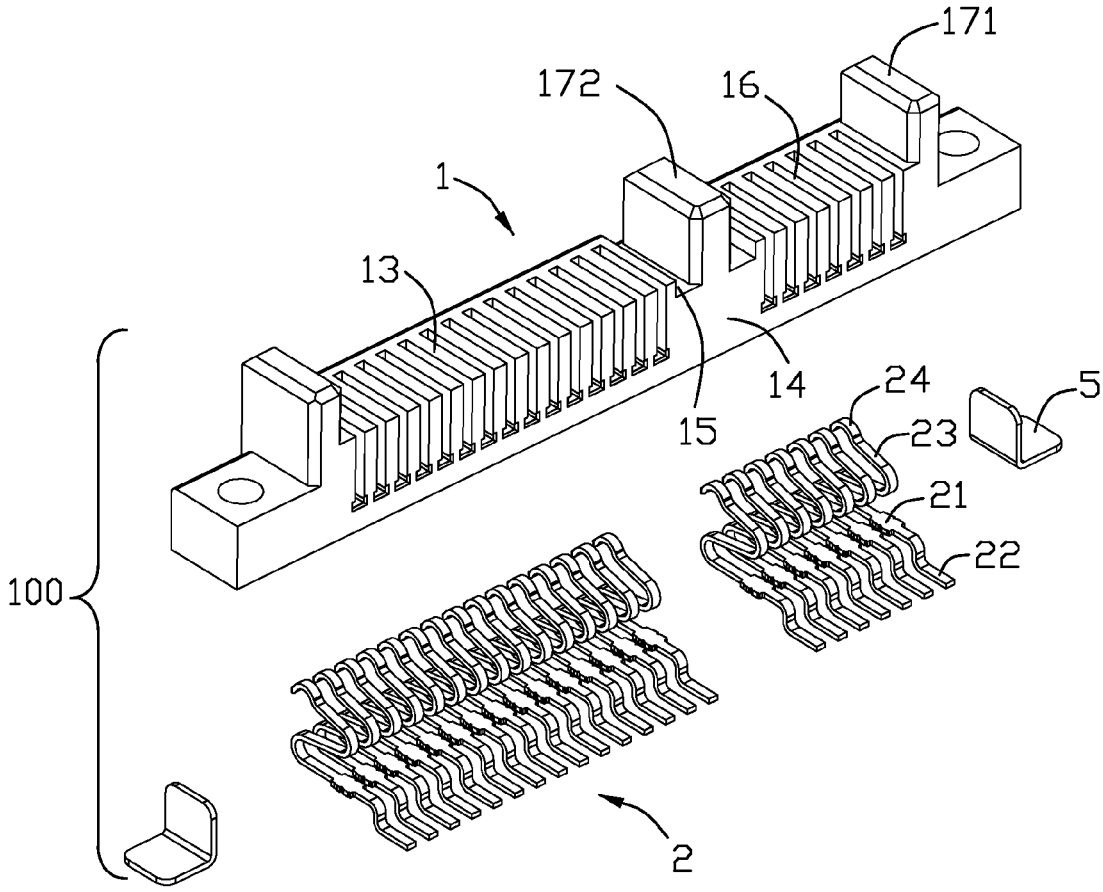
FIG. 2 is an exploded, perspective view of the electrical connector shown in FIG. 2.
Figure 3:
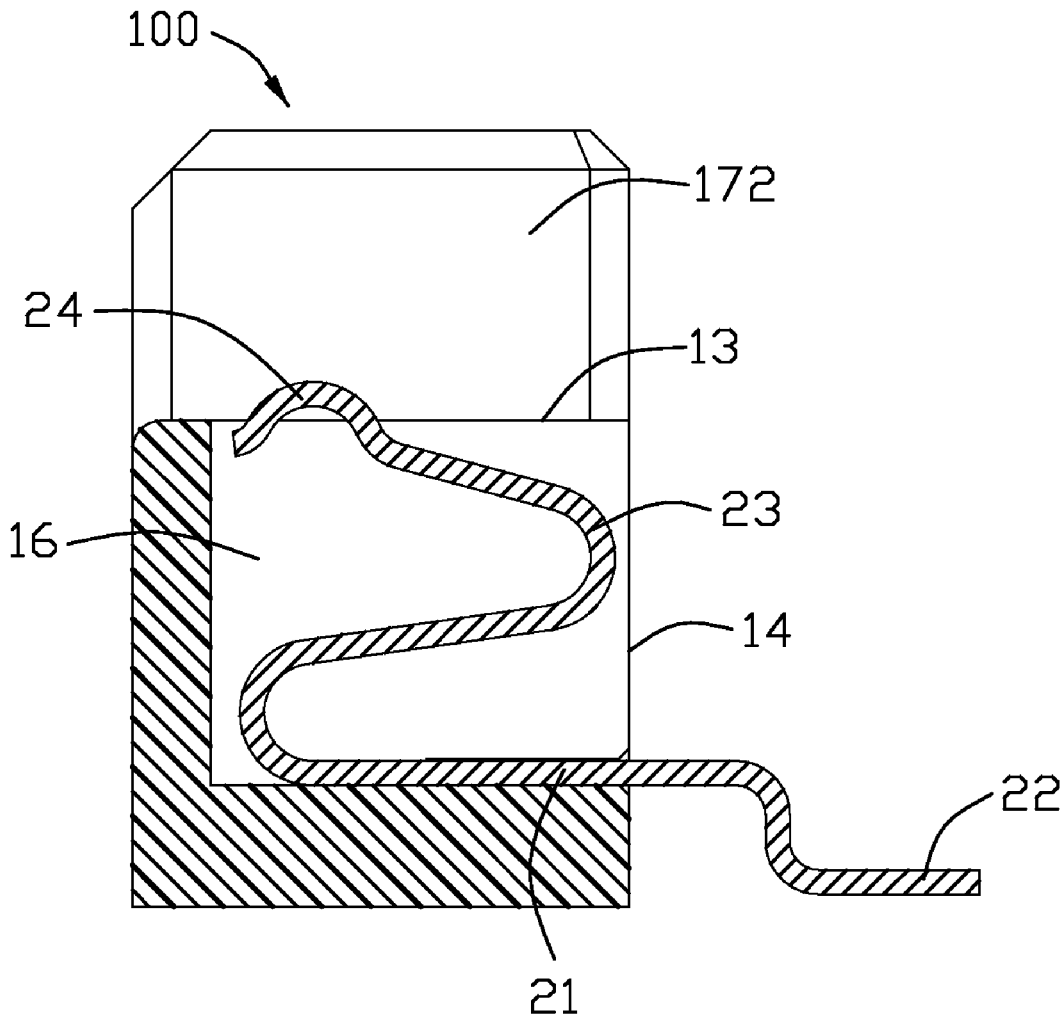
FIG. 3 is a cross sectional view of the electrical connector taken along line 3-3 of FIG. 1.

Referring to FIG. 1 through FIG. 3, the insulative base 1 is substantially elongated and integrally formed, and comprises a base section 10 and a pair of seat section 11 protruding outwardly from the base section 10 along a longitudinal direction thereof. A receiving hole 12 runs through each seat section 11 from a top-down direction. The base section 10 defines a top face 13 and a front face 14 perpendicular to the top face 13. A bottom face opposite to the top face is used as a mounting face on the circuit board 3. A plurality of receiving passageways 16 are defined in the base section 10 extending through the top face 13 and the front face 14. A pair of positioning posts 171 protrude from two opposite ends of the top face 13 and a third positioning post 172 protrude from the middle part of the top face 13 upwardly. The third positioning post 172 divides the receiving passageways 16 into two groups along the longitudinal direction. A pair of recesses 15 is defined adjacent to the third positioning post 172 and through the top face 13 and the front face 14.

Each terminal 2 includes a retention portion 21 with barbs at two lateral sides of the retention portion and a soldering end 22 and a resilient arm 23 extending from the two opposite ends of the retention portion 21 respectively. The resilient arm 23 is an inverted S-shape and defines a contacting end 24 on a free end thereof. The contacting ends 24 extend beyond the top face 13 and are of an inverted C-shape with a downward opening.

The electrical connector 100 further comprises a pair of pads 5 assembled on the longitudinal sides of the seat section 11 for being mounted the electrical connector 100 on the printed circuit board 3.

The complimentary connector 4 is retained on the hard disk and has a pair of L-shaped tongue boards 41 abutting against each other longitudinally. Each tongue board 41 has a long side 42 and a short side 43. The two short sides 43 are spaced from each other to form a receiving space 44 therebetween. The receiving space 44 is used for positioning the third positioning post 172, the short sides 43 seat in the recesses 15 of the insulative base 1. The long sides 42 confront with the top face 13.

In assembling, referring to FIGS. 1-5, the terminals 2 are assembled into the receiving passageways 16 along the longitudinal direction from the front face 14 to the back face (not labeled), the contacting ends 24 extend beyond the top face 13 and abut against the contact terminals (not shown) of the complimentary connector 4 correspondingly. Then, the electrical connector 100 is mounted onto the printed circuit board 3 and the complementary connector 4 can be assembled with the electrical connector 100 from top to down under a guidance between the corresponding positioning post 17 and the receiving space 44.

Summing up the foregoing, the complementary connector 4 can be assembled onto the electrical connector 100 in a vertical direction instead of a horizontal direction or an up-to-down direction instead of a left-to-right direction, thereby saving an assembling space on the printed circuit board. During assembling, the positioning posts 17 can be a positioning guidance and lead the complimentary connector 4 being assembled onto the electrical connector 100.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative base comprising a longitudinal base section with a top face and three positioning posts protruding upwardly form the top face along a longitudinal direction thereof, the base section defining two groups of receiving passageways, each group located between every two adjacent positioning posts, each receiving passageway running through the top face of the base section and a front face perpendicular to the top face; and a plurality of terminals retained in the receiving passageways, each terminal comprising a retention section, a resilient arm received in the passageway with an contacting end at a free end of the resilient arm and a soldering section extending out of the front face, wherein the contacting end is an arc-shape with an opening orienting to the top face; and a pair of recesses adjacent to a middle positioning post of said three positioning posts are recessed from the top face and running through the front face and a back face opposite to the front face.

2. The electrical connector as claimed in claim 1, wherein the retention section is parallel to the top face.

3. The electrical connector as claimed in claim 2, wherein the resilient arm is of an inversed S-shape.

4. An electrical connector assembly, comprising:

an insulative base having a base section and a pair of seat section extending longitudinally therefrom, the base section defining a plurality of receiving passageways, the receiving passageways running through a top face and a front face perpendicular to the top face of the base section, a back face being defined opposite to the front face, at least a positioning post protruding from the top face;

a plurality of terminals inserted into the receiving passageways in a direction from the front face to the back face; and a complimentary connector having a pair of tongue boards, each tongue board having a long side and a short side, the short sides of the two tongue board are adjacent to each other, a receiving space being defined between the short sides, the receiving space retaining a corresponding positioning post, the short sides assembling into a pair of recesses defined on two sides of said corresponding positioning post in an up-to-down direction.

5. The electrical connector as claimed in claim 4, wherein a pair of first positioning posts disposes at the longitude sides of the top face, a second positioning post disposes at the middle part of the top face.

6. The electrical connector as claimed in claim 4, wherein each terminal includes a contacting end extending beyond the top face of the insulative base.

7. The electrical connector as claimed in claim 4, wherein the tongue boards cooperate with the top face after assembling.

8. An electrical connector assembly comprising:

a first connector defining an elongated insulative first housing having a mating tongue with a downward first mating face;

a plurality of first contacts disposed in the first housing with stiff first contact sections exposed upon the mating face;

a second connector defining an elongated insulative second housing having a mating platform with an upward second mating face; and a plurality of resilient second contact sections exposed upon the second mating face; wherein the mating tongue is forwardly exposed to an exterior when said first connector is mated with the second connector; wherein said post is received in the space laterally beside the mating tongue, wherein said mating tongue is of an L-shaped cross-section and there are two said guiding posts laterally sandwiching said mating tongue therebetween; and wherein during mating, and the upward second mating face defines a recess beside the guiding post to receive a lowest edge of a vertical segment of said mating tongue.

9. The electrical connector assembly as claimed in claim 8, wherein during mating, the first connector is downwardly moved toward the second connector in a vertical direction until the downward first mating face and the upward second mating face intimately confront each other.

10. The electrical connector assembly as claimed in claim 8, wherein the second connector is mounted upon a printed circuit board.

11. The electrical connector assembly as claimed in claim 10, wherein the first connector is mounted in a electronic device.

* * * * *